US010449760B2

(12) United States Patent
Simons

(10) Patent No.: US 10,449,760 B2
(45) Date of Patent: Oct. 22, 2019

(54) METHOD FOR CANCELLING ELECTRIC CROSSTALK IN A PRINTHEAD

(71) Applicant: Océ Holding B.V., Venlo (NL)

(72) Inventor: Johannes M. M. Simons, Venlo (NL)

(73) Assignee: OCE HOLDING B.V., Venlo (NL)

( * ) Notice: Subject to any disclaimer, the term of this patent is extended or adjusted under 35 U.S.C. 154(b) by 0 days.

(21) Appl. No.: 16/159,396

(22) Filed: Oct. 12, 2018

(65) Prior Publication Data

US 2019/0061341 A1 Feb. 28, 2019

Related U.S. Application Data

(63) Continuation of application No. PCT/EP2017/058275, filed on Apr. 6, 2017.

(30) Foreign Application Priority Data

Apr. 14, 2016 (EP) ..... 16165297

(51) Int. Cl.
*B41J 2/045* (2006.01)
*B41J 2/14* (2006.01)

(52) U.S. Cl.
CPC ..... *B41J 2/04525* (2013.01); *B41J 2/0451* (2013.01); *B41J 2/04581* (2013.01); *B41J 2002/14354* (2013.01)

(58) Field of Classification Search
CPC .. B41J 2/04525; B41J 2/0451; B41J 2/04581; B41J 2002/14354
See application file for complete search history.

(56) References Cited

U.S. PATENT DOCUMENTS

2009/0029032 A1 1/2009 Miyasaka
2014/0267505 A1 9/2014 Nakao

FOREIGN PATENT DOCUMENTS

EP 1 584 474 A1 10/2005
EP 2 328 756 B1 5/2014
JP 2006-27036 A 2/2006

OTHER PUBLICATIONS

International Search Report for PCT/EP2017/058275 (PCT/ISA/210) dated Jun. 19, 2017.
Written Opinion of the International Searching Authority for PCT/EP2017/058275 (PCT/ISA/237) dated Jun. 19, 2017.

*Primary Examiner* — Bradley W Thies
(74) *Attorney, Agent, or Firm* — Birch, Stewart, Kolasch & Birch, LLP

(57) ABSTRACT

A method is provided for cancelling an electric crosstalk contribution in a monitoring signal from a monitored electro-mechanical transducer in a device including at least three electro-mechanical transducers. The crosstalk contribution results from an actuation of other transducers than the monitored transducer. The method includes selecting a second transducer, associated with the first, monitored transducer, wherein the electric crosstalk caused by an actuation of a third transducer is equal in the first and second transducer; actuating the first transducer and not acutating the second transducer; simultaneously measuring a monitoring signal from the first transducer and the second transducer; and subtracting the two monitoring signals to obtain a clean monitoring signal from the first transducer.

12 Claims, 2 Drawing Sheets

METHOD FOR CANCELLING ELECTRIC CROSSTALK IN A PRINTHEAD

CROSS REFERENCE TO RELATED APPLICATIONS

This application is a Continuation of PCT International Application No. PCT/EP2017/058275, filed on Apr. 6, 2017, which claims priority under 35 U.S.C. 119(a) to Patent Application No. 16165297.9, filed in Europe on Apr. 14, 2016, all of which are hereby expressly incorporated by reference into the present application.

BACKGROUND OF THE INVENTION

1. Field of the Invention

The invention relates to a method for cancelling an electric crosstalk contribution in a monitoring signal from a monitored electro-mechanical transducer in a device comprising at least three electro-mechanical transducers which are driven by actuation signals, the crosstalk resulting from an actuation of other transducers than the monitored transducer. More particularly, the invention relates to a method for cancelling an electric crosstalk in monitoring signals from transducers of a jetting device such as an ink jet print head, wherein electric signals produced by the transducers are used for monitoring a condition of the jetting device. The invention also relates to a jetting device, more particularly an ink jet print head in which the method is implemented.

2. Description of the Related Art

European Patent Application EP 1 584 474 A1 and European Patent EP 2 328 756 B1 describe embodiments of a piezoelectric ink jet print head having a plurality of jetting units for jetting out liquid ink onto a recording medium in order to form a printed image. Each jetting unit has a nozzle connected to a pressure chamber that is filled with liquid ink. The nozzles and, consequently, the jetting units are arranged at narrow spacings in order to achieve a high spatial resolution of the print head. Each pressure chamber is attached to a piezoelectric transducer, which, when energized by an electric signal, or pulse, deforms in a manner that causes a change in the volume of the pressure chamber. Consequently, an acoustic pressure wave is generated in the liquid ink in the pressure chamber, and this wave propagates to the nozzle, so that an ink droplet is ejected from the nozzle, if the pulse is sufficiently strong to be a jetting actuation signal.

Conversely, when a pressure wave is propagating in the liquid in the pressure chamber, this wave will cause a deformation of the electro-mechanical transducer, which will produce an electric signal (voltage and current signal) in response to the deformation. Consequently, as has been taught in the documents cited above, it is possible to detect the acoustic pressure waves in the pressure chambers by monitoring the signals obtained from the transducers. The pressure wave in the liquid of the pressure chamber may either be a residual wave after a jetting actuation signal has been applied with the result of a droplet ejection from the nozzle or a monitoring wave after the application of a non-jetting actuation signal that causes a wave in the liquid without the result of a droplet ejection. This last type of actuation is known for monitoring purposes, i.e. a verification of the status of the ink and/or the pressure chamber. In general, the amplitudes of electric signals involved for detecting either residual waves or monitoring waves are substantially smaller than the amplitudes of a jetting or non-jetting actuation signal.

When a transducer has been actuated, either by a jetting or by a non-jetting actuation, the pressure wave produced by this transducer will gradually decay in the pressure chamber in the course of time. If, for example, an air bubble has been trapped in the pressure chamber or in the nozzle, this will change, in a characteristic way, the pattern in which the pressure wave decays, so that the presence of the air bubble can be detected by monitoring the decay of the pressure wave.

Similarly, the monitoring signals obtained from the transducers may be used for detecting other conditions of the jetting units, e.g. a condition in which a nozzle is partly or completely clogged by contaminants. Examples of other conditions and/or ink properties that may be monitored in this way are the viscosity of the ink and the position of the air/liquid meniscus in the nozzle, which position changes the resonance frequency of the acoustic wave in the pressure chamber.

Since the plurality of transducers of the jetting device form part of a common actuating and monitoring circuitry and electrical leads of this circuitry are relative closely packed in the device, due to the close packing of the jetting units of the print head, there will inevitably be a certain amount of electric crosstalk between the actuators. Consequently, when one actuator is monitored while the jetting device is operating, the monitoring signal will reflect not only the pressure wave in the jetting unit that is being monitored, but will also include a certain amount of crosstalk from other transducers that have been actuated simultaneously. This may compromise the accuracy in the determination of the condition of the jetting unit.

It is therefore an object of the invention to cancel the crosstalk contribution in the monitoring signal, so that the monitoring signal can be processed and interpreted.

SUMMARY OF THE INVENTION

In order to achieve this object, the method according to the invention comprises the steps of: (a) selecting a second transducer, associated with a monitored first transducer, wherein the electric crosstalk caused by an actuation of a third transducer is equal in the first and second transducer; (b) actuating the first transducer and not actuating the second transducer; (c) simultaneously measuring a monitoring signal from the first transducer and the second transducer; (d) subtracting the two monitoring signals to obtain a clean monitoring signal from the first transducer.

The instantaneously received crosstalk in the first and second transducer being equal, which means that the crosstalk signal from the second transducer is proportional to the crosstalk signal in the first transducer, enables the possibility to directly subtract the crosstalk contribution in the monitoring signal, even before an analog-digital conversion (ADC) takes place. Since the electric crosstalk may be as large as or even (much) larger than the signal caused by an acoustic wave in the pressure chamber, this direct subtraction reduces the necessary dynamic range, or the number of bits, of the ADC. Compared to saving a crosstalk contribution at an earlier time as a reference, the invented method is more accurate and better capable of compensating for drift of the crosstalk signal.

In a further embodiment, the method is applied in an inkjet print head comprising an array of jetting units, a jetting unit comprising a pressure chamber attached to an electro-mechanical transducer. The electro-mechanical transducer is often a piezo-electric material in connection with a pressure chamber that is filled with ink. The ink is jetted in the form of a drop forming amount of ink from a nozzle at the end of the pressure chamber, if a sufficiently strong electric pulse, a jetting actuation signal, is applied to the piezo-electric transducer. The high density of jetting units with closely packed electrical leads in the print head, causes a high level of electrical crosstalk between the electric signals in various jetting units. By applying the invented method, a monitoring signal from one unit may be determined with less interference from the signals of other jetting units.

In a further embodiment, an actuation signal for actuating the first transducer is a non-jetting actuation signal. A non-jetting actuation signal is not sufficiently strong to generate an ink drop form the jetting unit, but still causes a pressure wave in the ink in the pressure chamber. This results in a rather small electric signal, at least compared to the crosstalk of jetting actuation signals for other jetting units. This small signal is made accessible for measurement by the invented method.

In a further embodiment, the clean monitoring signal is used to determine a status of the jetting unit associated with the first transducer. The status of a jetting unit may be determined from details in the monitoring signal. These details may be lost in the noise caused by the crosstalk, thereby obfuscating a discrepancy between various possible conditions of the jetting unit.

In a further embodiment, a third transducer is actuated with a jetting actuation signal. In operation, any third jetting unit may be actuated according to an intended scheme associated with the application of the jetting unit. Since the crosstalk is promptly subtracted, there is no need to wait for the jetting operation to be finished. As soon as two associated transducers are available, that means that they are ready for recording a monitoring signal, the method according to the invention may be applied. Thus, the method may be carried out while the device, e.g., the print head, is operating, so that the properties of the jetting devices can be monitored quasi continuously during the operation of the device.

More specific optional features of the invention are indicated in the dependent claims.

The invention may be embodied as a jetting device comprising a plurality of jetting units each of which has an electromechanical transducer and an electronic control circuit for driving the transducers and for receiving monitoring signals from the transducers, characterized in that the control circuit is configured to perform one of the methods as described above. The method may further be combined with other measures for suppressing acoustic and electric crosstalk thus obtaining an even higher accuracy.

Further scope of applicability of the present invention will become apparent from the detailed description given hereinafter. However, it should be understood that the detailed description and specific examples, while indicating preferred embodiments of the invention, are given by way of illustration only, since various changes and modifications within the scope of the invention will become apparent to those skilled in the art from this detailed description.

BRIEF DESCRIPTION OF THE DRAWINGS

An embodiment example will now be described in conjunction with the drawings, wherein.

DETAILED DESCRIPTION OF EMBODIMENTS

Figure 1:
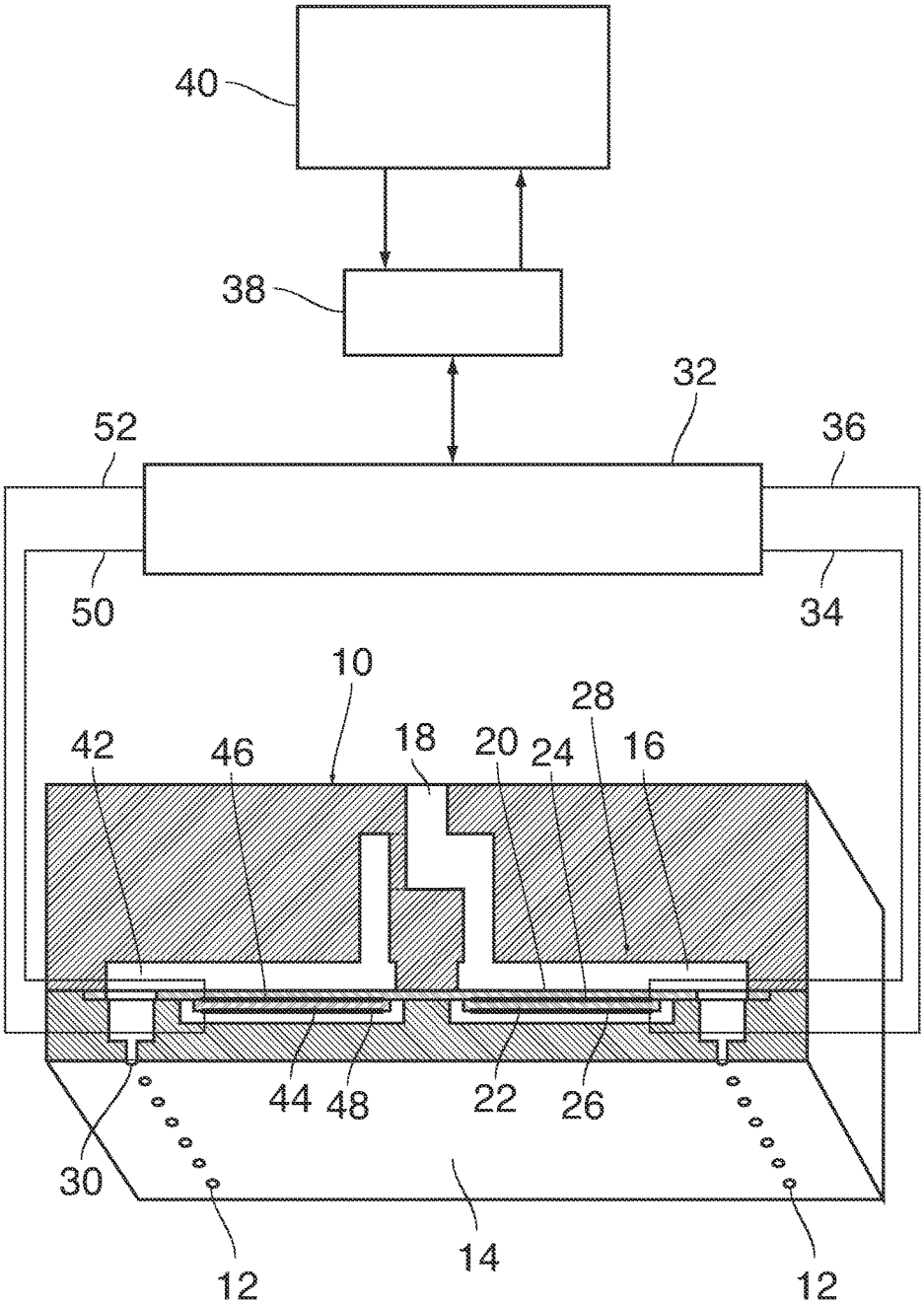
FIG. 1 is a perspective view, partly in section, of an ink jet print head as an example of a device to which the invention is applicable.

As is shown in FIG. 1, a droplet ejection device which may for example form part of an ink jet printer comprises a nozzle head 10 with plurality of nozzles 12 formed in a flat nozzle face 14. The nozzle head 10 may for example be formed by MEMS technology (Micro Electro Mechanical System).

Each nozzle 12 is connected to one end of a duct 16 that is filled with liquid ink. An opposite end of the duct 16 is connected to an ink supply line 18 that is common to all the nozzles 12 and ducts 16 of the entire nozzle head. One wall of each duct 16 is formed by a flexible membrane 20 to which an electro-mechanical transducer 22 is attached on the side outside of the duct 16. The transducer 22 has a number of electrodes 24 only two of which have been shown here. The transducer 22 may be a piezoelectric transducer with a plurality of layers of piezoelectric material stacked one upon the other and with internal electrodes intervening therebetween. The internal electrodes inside the piezoelectric material will then alternatingly be connected with the electrode 24 on the top side and the electrode 26 on the bottom side. When a voltage is applied to the electrodes, this will cause the transducer 22 to flex in a bending mode, resulting in a deflection of the membrane 20.

For example, when a voltage pulse is applied as an activation pulse to the electrodes 24 and 26, the membrane 20 may flex downwardly so as to increase the volume inside the duct 16 at the rising flank of the pulse, so that ink will be sucked-in from the ink supply line 18. Then, on the descending flank at the end of the pulse, the membrane 20 will flex back into the original state, thereby compressing the ink in the duct 16, so that an acoustic pressure wave is generated in the liquid ink. This pressure wave propagates to the end of the duct 16 that is connected to the nozzle 12 and causes an ink droplet to be expelled from the nozzle.

The assembly constituted by a single one of the nozzles 12, the associated duct 16 and the associated transducer 22 will be designated as ejection unit 28 hereinafter.

In the example shown, the nozzles 12 are arranged in two parallel rows and each of these nozzles. A single nozzle 30 is shown in cross-section in the left part of FIG. 1 and forms part of another ejection device 28. The ejection devices 28 have all an identical design and are arranged mirror-symmetrically for the two rows of nozzles 12. The electrodes 24 and 26 of each ejection unit 28 are connected to an electronic control circuit 32 via signal lines 34, 36 which have been shown only schematically in FIG. 1 and have been show only for a single one of the ejection units 28.

The control circuit 32 may take the form of an ASIC (Application Specific Integrated Circuit) and is arranged to generate the activation pulses to be applied to the electrodes of the transducers 22 of each ejection unit.

When one of the transducers 22 is subject to pressure fluctuations that may have been caused for example by a previous activation pulse of the same ejection unit or a neighbouring unit, this will cause a slight deformation of the piezoelectric material, so that a voltage will be induced in the electrodes 24, 26. This induced voltage forms a detection signal that is also transmitted to the control circuit 32 via the signal lines 34 and 36 and may be used for analyzing and assessing the pressure fluctuations in the ejection unit. When the ejection unit operates normally, a characteristic pattern of a decaying pressure wave will be detected subsequent to each activation pulse. However, when any kind of malfunction occurs in the ejection unit, e.g. a complete or partial clogging of the nozzle 12, an air bubble being trapped in the nozzle or the duct, or mechanical damage of the transducer 22 or of the membrane 20, this will change the pattern of pressure fluctuations in a characteristic way. Consequently, by analysing the detected pressure fluctuations, it is possible to state that a malfunction has occurred, and it is also possible to identify the nature of the malfunction.

The control circuit 32 communicates with an FPGA 38 (Field Programmable Gate Array) that determines, under the control of a processor unit 40, the ejection units 28 to which the activation pulses are to be delivered, and the ejection units from which detection signals are to be received. In this way, the nozzle head 10 can be controlled such that a desired image is formed on a print substrate (not shown) that is advanced underneath the nozzle face 14, and the functioning of the ejection units 28 can be monitored continuously during the print process.

The voltage that is induced in the electrodes 24 and 26 of a transducer 22 of an ejection unit 28 will depend not only upon the acoustic waves in the liquid in the duct 16 but, due to the close packing of the jetting units of the print head, inevitably will be affected by the actuation signals that are simultaneously given to neighbouring ejection units. This is the electric crosstalk resulting from a common actuating and monitoring circuitry having electrical leads that are relative closely packed. Furthermore, the induced voltage will also be influenced by several other factors including, for example, the temperature of the transducer, secular changes (ageing) in the mechanical properties of the transducer and the membrane, and the like. Besides, the nozzle head may be subject to external shocks which cause vibrations in the solid material of the nozzle head. These vibrations will be transmitted to the transducer via the membrane 20 and will cause noise signals in the electrodes.

Most of these factors will influence the voltage at the electrodes 24, 26 and 46, 48 of the several ejection units in essentially the same way. It has been found that a pair of transducers may be selected that show a similar monitoring signal when other transducers are activated. One transducer 22 is associated with a second transducer 44, if they show an equal response to activation of third transducers. After this selection, the first transducer 22 is monitored by an application of an activation signal, either jetting or non-jetting, and simultaneously the second, associated transducer 44 is not activated. A monitoring signal from both transducers is measured and the two signals are subtracted to obtain a clean monitoring signal for the first transducer 22. This signal will represent only the pressure fluctuations and acoustic waves in the liquid in duct 16, i.e. the information one is actually interested in, whereas all external disturbance factors will essentially cancel out.

Figure 2:
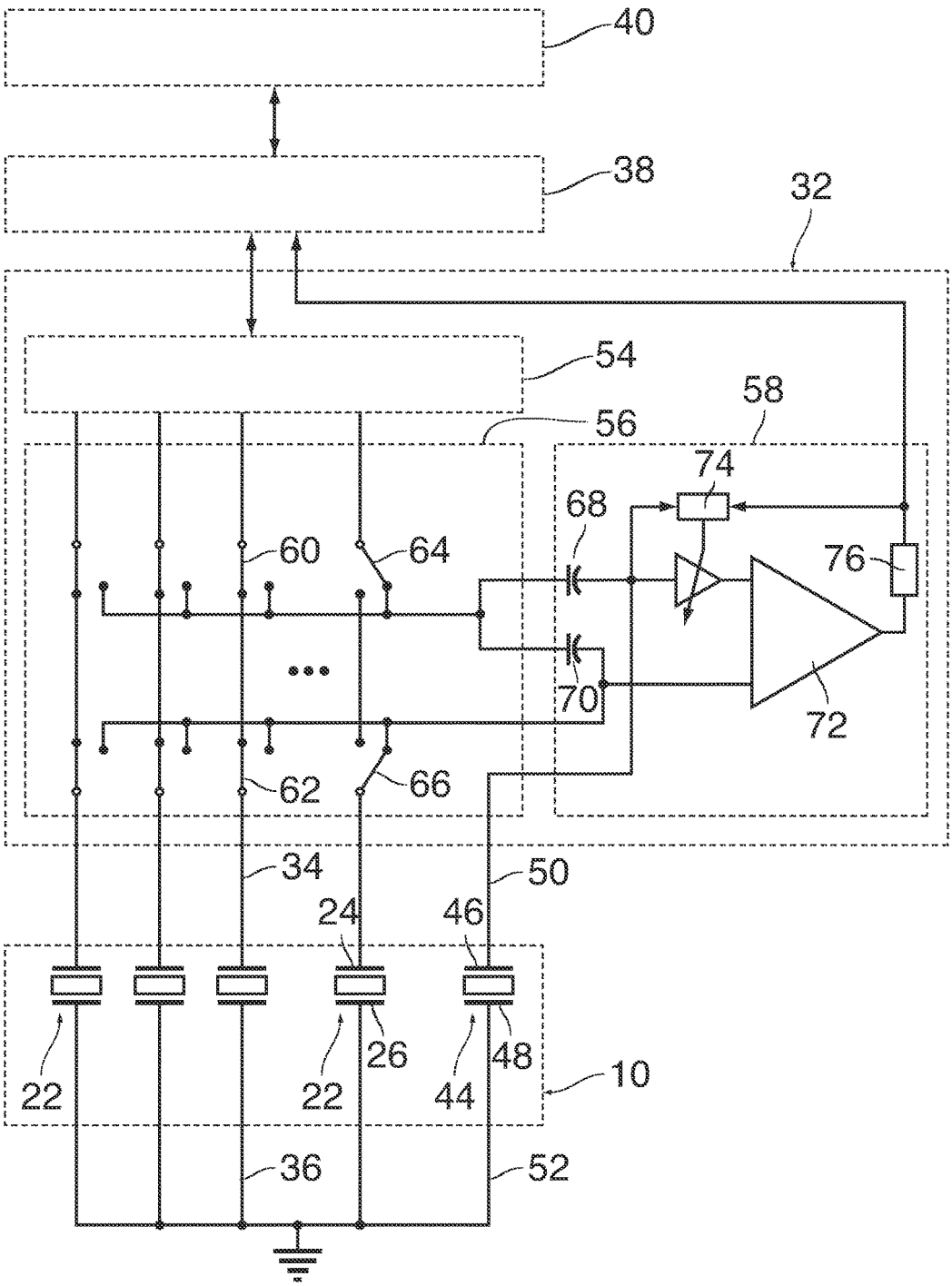
FIG. 2 is an electric circuit diagram of the device shown in FIG. 1.

FIG. 2 is a more detailed circuit diagram of the control circuit 32, including the transducer 22 and the associated transducer 44 which, electronically, can be considered as capacitors.

The control circuit 32 includes a waveform generator 54, an output stage 56 and a detection circuit 58. The waveform generator 54 generates control signals with waveforms consisting of activation pulses for individually controlling each of the transducers 22 of the ejection units under the control of the FPGA 38. To that end, the waveform generator has a separate output for each transducer 22. The output stage 56 includes a network of switches 60, 62, 64, 66 arranged to connect each of the transducers 22 to the corresponding output of the waveform generator 54 either directly or indirectly via the detection circuit 58. In the example shown, the switches 60 and 62 are closed, so that the corresponding transducer is directly connected to the waveform generator 54 and disconnected from the detection circuit 58. In contrast, switches 64 and 66 are shown in a state, in which the direct connection is interrupted and, instead, the output of the waveform generator 54 is connected to an input of the detection circuit 58 (via switch 64), and an output of the detection circuit is connected to the associated transducer 22 (via switch 66).

The input of the detection circuit 58 splits into two branches each of which contains a capacitor 68 and 70, respectively. The capacitor 68 is connected to one input of a comparator 72 via a self-balancing circuit 74 and is further connected to one electrode 46 of the associated transducer 44. This associated transducer may also be selected through a network of switches, which has been omitted from FIG. 2 for clarity. The capacitor 70 is connected to another input of the comparator 72 and, via the closed switch 66, to one electrode 24 of the associated transducer 22. The other electrodes 26 and 48 of the transducers 22 and the associated transducer 44 are grounded.

The capacitors 68, 70, the transducer 22 that is connected to the detection circuit 58, and the associated transducer 44 constitute a bridge circuit that is balanced by means of the self-balancing circuit 74 such that, when no pressure waves are present in the duct 16, the output of the comparator 72 will be zero. The analog output is digitised in an A/D-converter 76, and the digitised output is transmitted to the processor unit 40 via the FPGA 38 and is further fed back to the self-balancing circuit 74. The capacitors 68 and 70 function in this circuit act as bridge balancing elements and may also be implemented as resistors or combinations of passive electronic components, as long as they are able to balance the bridge circuit in a relevant frequency range.

Since both inputs of the comparator 72 are connected to the switch 64 via the capacitors 68 and 70, the output of the comparator will not change when the level the voltage signal that is output via the switch 64 changes.

When an activation pulse occurs at this output, the voltage pulse will be transmitted to the transducer 22 via the capacitor 70 and the closed switch 66, and the associated nozzle 12 will be fired. During this time, and also during the subsequent time interval when the activation pulse has dropped-off again, the detection signal from this transducer 22 will constantly be measured by the detection circuit 58. When pressure fluctuations occur in the liquid in the duct 16 associated with transducer 22, a voltage will be induced in the electrode 24 of the transducer 22, and this voltage will cause an imbalance at the inputs of the comparator 72, and a corresponding detection signal will be sent from the A/D-converter 76 to the processor unit 40.

The switches 60-66 may be controlled either by the processor unit 40 or by an internal controller of the control circuit 32, so that the transducers 22 of all ejection units 28 may be connected to the measuring circuit 28 one after the other in accordance with a predetermined time pattern and, consequently, the functioning of all ejection units can be monitored with high time resolution.

The invention being thus described, it will be obvious that the same may be varied in many ways. Such variations are not to be regarded as a departure from the scope of the invention, and all such modifications as would be obvious to one skilled in the art are intended to be included within the scope of the following claims.

The invention claimed is:

1. A method for cancelling an electric crosstalk contribution in a monitoring signal from a monitored first electro-mechanical transducer in a device comprising at least three electro-mechanical transducers, which are driven by actuation signals, the crosstalk contribution resulting from an actuation of other transducers than the monitored transducer, the method comprising the steps of:

selecting a second transducer, associated with the first transducer, wherein the electric crosstalk caused by an actuation of a third transducer is equal in the first and second transducer;

actuating the first transducer and not actuating the second transducer;

simultaneously measuring a monitoring signal from the first transducer and the second transducer; and subtracting the two monitoring signals to obtain a clean monitoring signal from the first transducer.

2. The method according to claim 1, wherein the device is an inkjet print head comprising an array of jetting units, a jetting unit comprising a pressure chamber attached to an electro-mechanical transducer.

3. The method according to claim 2, wherein an actuation signal for actuating the first transducer is a non-jetting actuation signal.

4. The method according to claim 3, wherein the third transducer is actuated with a jetting actuation signal.

5. A jetting device comprising:

a plurality of jetting units each of the plurality of jetting units including an electromechanical transducer, and an electronic control circuit for driving the transducers and for receiving monitoring signals from the transducers, wherein the control circuit is configured to perform the method according to claim 4.

6. A jetting device comprising:

a plurality of jetting units each of the plurality of jetting units including an electromechanical transducer, and an electronic control circuit for driving the transducers and for receiving monitoring signals from the transducers, wherein the control circuit is configured to perform the method according to claim 3.

7. The method according to claim 2, wherein the clean monitoring signal is used to determine a status of the jetting unit associated with the first transducer.

8. A jetting device comprising:

a plurality of jetting units each of the plurality of jetting units including an electromechanical transducer, and an electronic control circuit for driving the transducers and for receiving monitoring signals from the transducers, wherein the control circuit is configured to perform the method according to claim 7.

9. A jetting device comprising:

a plurality of jetting units each of the plurality of jetting units including an electromechanical transducer, and an electronic control circuit for driving the transducers and for receiving monitoring signals from the transducers, wherein the control circuit is configured to perform the method according to claim 2.

10. The method according to claim 1, comprising an additional step of saving the selected second transducer as an associated transducer to the first transducer.

11. A jetting device comprising:

a plurality of jetting units each of the plurality of jetting units including an electromechanical transducer, and an electronic control circuit for driving the transducers and for receiving monitoring signals from the transducers, wherein the control circuit is configured to perform the method according to claim 10.

12. A jetting device comprising:

a plurality of jetting units, each of the plurality of the jetting units including an electromechanical transducer, and an electronic control circuit for driving the transducers and for receiving monitoring signals from the transducers, wherein the control circuit is configured to perform the method according to claim 1.

* * * * *